US005474604A

United States Patent [19]

Demmering et al.

[11] Patent Number: 5,474,604

[45] Date of Patent: Dec. 12, 1995

[54] FATTY MIXTURES

[75] Inventors: Guenter Demmering, Solingen; Karl-Heinz Schmid; Michael Koehler, both of Mettmann; Detlev Stanislowski, Ratingen, all of Germany

[73] Assignee: Henkel Kommanditgesellschaft auf Aktien, Duesseldorf, Germany

[21] Appl. No.: 244,162

[22] PCT Filed: Nov. 10, 1992

[86] PCT No.: PCT/EP92/02580

§ 371 Date: May 19, 1994

§ 102(e) Date: May 19, 1994

[87] PCT Pub. No.: WO93/10205

PCT Pub. Date: May 27, 1993

[30] Foreign Application Priority Data

Nov. 19, 1991 [DE] Germany ..... 41 37 997.7

[51] Int. Cl.[6] ..... C09D 191/06; C10M 101/04

[52] U.S. Cl. ..... 106/38.24; 252/56 R

[58] Field of Search ..... 252/56 R; 106/38.24, 106/38.22

[56] References Cited

U.S. PATENT DOCUMENTS

| | | | |
|---|---|---|---|
| 3,893,868 | 7/1975 | Klement et al. | 106/38.24 |
| 4,024,088 | 5/1977 | Godlewski | 252/182 |
| 4,087,398 | 5/1978 | Heyden et al. | 252/321 |
| 4,157,990 | 7/1979 | Linder et al. | 252/56 S |
| 4,639,484 | 1/1987 | Percell | 524/318 |
| 5,100,697 | 3/1992 | Nielsen | 106/38.24 |
| 5,308,393 | 5/1994 | Hättich et al. | 106/38.24 |

FOREIGN PATENT DOCUMENTS

| | | |
|---|---|---|
| 0328158 | 8/1989 | European Pat. Off. . |
| 2553900 | 6/1977 | Germany . |
| 2705089 | 12/1986 | Germany . |

OTHER PUBLICATIONS

Fat. Sci. Technol. 89, 237 (1987) (No Month).

Fat. Sci. Technol. 92, 473 (1991) (No Month).

*Primary Examiner*—Margaret Medley
*Attorney, Agent, or Firm*—Ernest G. Szoke; Wayne C. Jaeschke; Real J. Grandmaison

[57] ABSTRACT

Fatty mixtures containing fatty alcohols having 16 to 24 carbon atoms, wax esters and fatty ketones are solid at temperatures of up to 65° C. and are particularly useful as mold release agents in the building, rubber and plastics-processing industries.

10 Claims, No Drawings

FATTY MIXTURES

FIELD OF THE INVENTION

This invention relates to fatty mixtures containing fatty alcohols with 16 to 24 carbon atoms, wax esters and fatty ketones and to their use as mold release agents.

PRIOR ART

Animal and vegetable fats and oils have been used for centuries as mold release agents. As a result of increasing industrialization, however, the fats initially used for this purpose were increasingly replaced by mineral oils which were available in large quantities. It is only in conjunction with environmental awareness which has increased dramatically in recent years that the need for satisfactorily biodegradable products has arisen —a requirement which cannot be satisfied by products based on mineral oils [Fat Sci. Technol. 89, 237 (1987)].

The use of fatty acid esters and wax esters as ecologically safe mold release agents, for example in the production of concrete and in the tire industry, has long been known and is widely documented. On account of their structure, however, the esters have a melting point which is generally too low for their use as mold release agents. In addition, mold release agents predominantly containing esters are attended by the disadvantage that the esters are in danger of cleavage on contact with alkaline substances or of contributing towards unwanted softening of the materials, for example certain plastics [Fat. Sci. Technol. 92,473 (1991)].

A possible alternative to the development of high-melting, hydrolysis-resistant mold release agents is the use of long-chain fatty alcohols. However, since long-chain fatty alcohols have softening points below 50° C., they are of only limited suitability for the required application. Even the addition of small quantities of wax esters to the fatty alcohols does not lead to a significant improvement in temperature behavior. On the contrary, a reduction in melting point is observed in a number of cases.

Accordingly, the problem addressed by the present invention was to provide new mold release agents which would be free from the disadvantages mentioned above.

DESCRIPTION OF THE INVENTION

The present invention relates to fatty mixtures containing a) fatty alcohols corresponding to formula (I):

$$R^1—OH \quad (I)$$

in which $R^1$ is a saturated, linear, optionally hydroxy-substituted alkyl radical with the following C chain distribution:

| | |
|---|---|
| $<C_{18}$ | 0 to 9% by weight |
| $C_{18}$ | 32 to 88% by weight |
| $C_{20}$ | 2 to 43% by weight |
| $C_{22}$ | 4 to 52% by weight |
| $>C_{22}$ | 0 to 15% by weight |

b) wax esters corresponding to formula (II):

$$R^2CO—OR^3 \quad (II)$$

in which $R^2CO$ is an optionally hydroxy-substituted acyl radical containing 16 to 24 carbon atoms and 0 or 1 double bond and $R^3$ is an optionally hydroxy-substituted aliphatic hydrocarbon radical containing 16 to 24 carbon atoms and 0 or 1 double bond and c) fatty ketones corresponding to formula (III):

$$R^4—CO—R^5 \quad (III)$$

in which $R^4$ and $R^5$ independently of one another represent alkyl radicals containing 15 to 24 carbon atoms.

It has surprisingly been found that the softening point of mixtures of long-chain fatty alcohols and wax esters can advantageously be increased by addition of fatty ketones to the mixtures and that the products are eminently suitable for use as mold release agents for a variety of industrial applications. In addition, the mold release agents are distinguished by high hydrolysis stability and by ready biodegradability which meets the general requirement for ecologically safe products.

Fatty alcohols corresponding to formula (I) suitable for use as component a) contain 16 to 24 carbon atoms. Typical examples are cetyl alcohol, stearyl alcohol, 12-hydroxystearyl alcohol, arachyl alcohol and behenyl alcohol.

As usual in oleochemistry, the fatty alcohols may also be used in the form of technical cuts. Suitable starting materials for this purpose are, for example, methyl esters based on rapeseed oil rich in erucic acid, peanut oil, castor oil, meadowfoam oil, beef tallow or fish oil which are subjected to high pressure hydrogenation. Not only is the ester group reduced to the hydroxyl function, double bonds present in the fatty chain are also substantially saturated at the same time. Antifoam agents having particularly valuable performance properties contain fatty alcohols with carbon chain lengths in the range mentioned which have iodine values below 10 and preferably in the range from 0.1 to 5.

Fatty alcohol mixtures particularly suitable as component a) for the production of the hydrolysis-stable mold release agents can be characterized by the following C chain distribution:

| | |
|---|---|
| $< C_{18}$: | 0 to 6% by weight |
| $C_{18}$: | 35 to 71% by weight |
| $C_{20}$: | 4 to 33% by weight |
| $C_{22}$: | 20 to 52% by weight |
| $> C_{22}$: | 0 to 9% by weight |

Fatty alcohols or fatty alcohol mixtures which have a hydroxyl value of 180 to 200 and a softening point above 55° C. and which are obtained as tailings in the distillation of fatty alcohols based on beef tallow are particularly preferred.

Wax esters corresponding to formula (II) which may be used as component b) are understood to be the esters of $C_{16-24}$ fatty acids with $C_{16-24}$ fatty alcohols. Typical examples are the esters of palmitic acid, stearic acid, 12-hydroxystearic acid, arachic acid and behenic acid with cetyl alcohol, stearyl alcohol, 12-hydroxystearyl alcohol, arachyl alcohol and behenyl alcohol. In addition, the wax esters may contain small quantities of unsaturated components both on the fatty acid side and on the fatty alcohol side. Wax esters having an iodine value below 10 and preferably from 0.1 to 5 are preferred. Typical examples are stearyl stearate, stearyl behenate and behenyl behenate. The products may be produced from pure or technical fatty acids and corresponding fatty alcohols which are esterified by methods known per se.

One particular embodiment of the invention is characterized by the use of technical wax esters which accumulate as residue in the hydrogenation of $C_{16-24}$ fatty acid methyl esters to the corresponding fatty alcohols.

Fatty ketones corresponding to formula (III), which are used as component c), are known substances which may be obtained by the relevant methods of preparative organic chemistry. They are produced, for example, from fatty acid magnesium salts which are pyrolyzed at temperatures above 300° C. with elimination of $CO_2$ and water [DE-OS 25 53 900]. Typical examples are fatty ketones which are prepared by pyrolysis of the magnesium salts of palmitic acid, stearic acid, arachic acid, behenic acid and technical mixtures thereof, for example $C_{16-18}$ tallow fatty acid. Stearone (18-pentatriacontanone) is preferably used.

The fatty mixtures may contain the fatty alcohols typically in quantities of 50 to 98% by weight and preferably in quantities of 70 to 90% by weight; the wax esters in quantities of 2 to 20% by weight and preferably in quantities of 5 to 12% by weight; and the fatty ketones in quantities of 2 to 20% by weight and preferably in quantities of 10 to 15% by weight. The concentrations mentioned are based on the sum of components a), b) and c).

To produce the fatty mixtures, it is advisable to heat the substances with stirring to a temperature above the melting point of the component with the highest melting point and then to allow the melt to solidify.

The fatty mixtures according to the invention are solid at temperatures of up to 65° C. and, on melting, form a homogeneous, non-blocking and non-tacky film. In addition, they are readily biodegradable.

Accordingly, the present invention also relates to the use of the fatty mixtures according to the invention as mold release agents in the building industry, the rubber industry and the plastics-processing industry.

The following Examples are intended to illustrate the invention without limiting it in any way.

EXAMPLES

Formulations A, B and C represent fatty mixtures of wax-like consistency which, on heating, melt without decomposing and form a non-blocking film. However, in the measurement of the melting points of the products on a heating rail, it was found that only formulation C satisfied the "solid up to 65° C." requirement.

TABLE 1

Formulations and softening points
Percentages as % by weight

| Components | Formulation A | Formulation B | Formulation C |
|---|---|---|---|
| Fatty alcohol mixture | 100 | 90 | 77 |
| Wax ester | — | — | 8 |
| Stearone | — | 10 | 15 |
| Softening point (°C.) | 52 | 57 | 70 |

Formulation C corresponds to the invention while formulations A and B are intended for comparison.

Legend:

| | | |
|---|---|---|
| Fatty alcohol mixture: | C chain distribution | |
| | $< C_{18}$: | 5% by weight |

-continued

Legend:

| | | |
|---|---|---|
| | $C_{18}$: | 50% by weight |
| | $C_{20}$: | 10% by weight |
| | $C_{22}$: | 30% by weight |
| | $> C_{22}$: | 5% by weight |
| | Hydroxyl value: | 190 |
| | Iodine value: | 4 |
| | Softening point: | 53° C. |
| Wax ester: | Technical stearyl stearate from the residue left in the hydrogenation of tallow fatty acid methyl ester | |
| | Hydroxyl value: | 93 |
| | Saponification value: | 45 |
| | Iodine value: | 5 |
| | Softening point: | 50° C. |

We claim:

1. Fatty mixtures containing (a) from 70 to 90% by weight of fatty alcohols corresponding to formula (I):

$$R^1OH \quad (I)$$

in which $R^1$ is a saturated, linear, optionally hydroxy-substituted alkyl radical with the following C chain distribution:

| | |
|---|---|
| $<C_{18}$ | 0 to 9% by weight, |
| $C_{18}$ | 32 to 88% by weight, |
| $C_{20}$ | 2 to 43% by weight, |
| $C_{22}$ | 4 to 52% by weight, |
| $>C_{22}$ | 0 to 15% by weight, |

b) from 5 to 12% by weight of wax esters corresponding to formula (II):

$$R^2CO—OR^3 \quad (II)$$

in which $R^2CO$ is an optionally hydroxy-substituted acyl radical containing 16 to 24 carbon atoms and 0 or 1 double bond and $R^3$ is an optionally hydroxy-substituted aliphatic hydrocarbon radical containing 16 to 24 carbon atoms and 0 or 1 double bond, and c) from 10 to 15% by weight of fatty ketones corresponding to formula (III):

$$R^4—CO—R^5 \quad (III)$$

in which $R^4$ and $R^5$ independently of one another represent alkyl radicals containing 15 to 24 carbon atoms, all weights being based on the weight of said fatty mixtures, wherein said fatty mixtures are solid at temperatures of up to 65°.

2. Fatty mixtures as in claim 1 wherein said fatty alcohols corresponding to formula (I) have a hydroxyl value of 180 to 200.

3. Fatty mixtures as in claim 1 wherein said fatty alcohols corresponding to formula (I) have a softening point above 55° C.

4. A mold release agent composition comprising a fatty mixture containing (a) from 70 to 90% by weight of fatty alcohols corresponding to formula (I):

$$R^1OH \quad (I)$$

in which $R^1$ is a saturated, linear, optionally hydroxy-substituted alkyl radical with the following C chain distribution:

| | |
|---|---|
| $<C_{18}$ | 0 to 9% by weight, |
| $C_{18}$ | 32 to 88% by weight, |
| $C_{20}$ | 2 to 43% by weight, |
| $C_{22}$ | 4 to 52% by weight, |
| $>C_{22}$ | 0 to 15% by weight, |

b) from 5 to 12% by weight of wax esters corresponding to formula (II):

$$R^2CO—OR^3 \quad \text{(II)}$$

in which $R^2CO$ is an optionally hydroxy-substituted acyl radical containing 16 to 24 carbon atoms and 0 or 1 double bond and $R^3$ is an optionally hydroxy-substituted aliphatic hydrocarbon radical containing 16 to 24 carbon atoms and 0 or 1 double bond, and c) from 10 to 15% by weight of fatty ketones corresponding to formula (III):

$$R^4—CO—R^5 \quad \text{(III)}$$

in which $R^4$ and $R^5$ independently of one another represent alkyl radicals containing 15 to 24 carbon atoms, all weights being based on the weight of said fatty mixture wherein said fatty mixture is solid at temperatures of up to 65°.

5. A composition as in claim 1 wherein said fatty alcohols have a hydroxyl value of 180 to 200.

6. A composition as in claim 1 wherein said fatty alcohols have a softening point above 55° C.

7. A composition as in claim 1 wherein said fatty alcohols contain 16 to 24 carbon atoms.

8. A composition as in claim 1 wherein said fatty alcohols have an iodine value below 10.

9. A composition as in claim 1 wherein said wax esters have an iodine value below 10.

10. A composition as in claim 1 wherein said fatty ketones contain stearone.

* * * * *